US007422256B2

(12) United States Patent
Mueller

(10) Patent No.: US 7,422,256 B2
(45) Date of Patent: Sep. 9, 2008

(54) LIFTING SLING WITH EXCESSIVE ELONGATION WARNING INDICATOR

(76) Inventor: DeWayne Mueller, 351 Heckecher Dr., Jacksonville, FL (US) 32226

( * ) Notice: Subject to any disclaimer, the term of this patent is extended or adjusted under 35 U.S.C. 154(b) by 333 days.

(21) Appl. No.: 11/368,142

(22) Filed: Mar. 3, 2006

(65) Prior Publication Data

US 2007/0205618 A1 Sep. 6, 2007

(51) Int. Cl.
*B66C 1/12* (2006.01)

(52) U.S. Cl. ..... 294/74; 73/862.56

(58) Field of Classification Search ..... 294/74, 294/907; 116/208, 212; 73/828, 862.53, 73/862.56; 177/263

See application file for complete search history.

(56) References Cited

U.S. PATENT DOCUMENTS

| | | | | | |
|---|---|---|---|---|---|
| 1,861,638 | A | * | 6/1932 | Martin | 73/130 |
| 2,071,694 | A | | 2/1937 | Howe | |
| 2,382,351 | A | | 8/1945 | Thorpe | |
| 2,387,737 | A | | 10/1945 | Black | |
| 2,393,053 | A | | 1/1946 | Moore | |
| 3,463,534 | A | * | 8/1969 | Norton | 294/74 |
| 3,466,080 | A | * | 9/1969 | Norton | 294/74 |
| 3,572,091 | A | | 3/1971 | McFarland | |
| 3,613,679 | A | | 10/1971 | Bijou | |
| 3,926,227 | A | * | 12/1975 | Takada et al. | 139/383 R |
| 4,102,295 | A | | 7/1978 | Crook, Jr. et al. | |
| 4,210,089 | A | | 7/1980 | Lindahl | |
| 4,213,463 | A | | 7/1980 | Osenkarski | |
| 4,245,512 | A | * | 1/1981 | Saunders | 73/789 |
| 4,249,474 | A | * | 2/1981 | Archer | 116/212 |
| 4,348,907 | A | | 9/1982 | Giese | |
| 4,562,743 | A | | 1/1986 | Bonine | |
| 4,757,719 | A | | 7/1988 | Franke | |
| 4,850,629 | A | | 7/1989 | St. Germain | |
| 4,958,853 | A | * | 9/1990 | Doty | 280/801.1 |
| 4,992,778 | A | | 2/1991 | McKeen et al. | |
| 5,195,950 | A | | 3/1993 | Delannoy | |
| 5,333,509 | A | | 8/1994 | Dimen | |
| 5,461,926 | A | | 10/1995 | Bobb et al. | |
| 5,461,927 | A | | 10/1995 | Bobb et al. | |
| 5,639,968 | A | | 6/1997 | Bobb et al. | |
| 5,651,572 | A | | 7/1997 | St. Germain | |
| 5,727,833 | A | | 3/1998 | Coe | |
| 5,779,659 | A | | 7/1998 | Allen | |
| 6,050,967 | A | | 4/2000 | Walker et al. | |
| 6,152,893 | A | | 11/2000 | Pigg et al. | |
| 6,422,624 | B1 | | 7/2002 | Kauffman et al. | |
| 2006/0261617 | A1 | * | 11/2006 | St. Germain | 294/74 |

* cited by examiner

*Primary Examiner*—Dean J Kramer
(74) *Attorney, Agent, or Firm*—Thomas C. Saitta

(57) ABSTRACT

A lifting sling having warning markings that indicate the extent of elongation of the sling under load, whereby an operator can visually determine if the maximum safe load weight of the sling has been exceeded. The markings are disposed on the surface of the sling cover and initially covered by a non-elongating body, but are exposed as the sling elongates under load.

18 Claims, 2 Drawing Sheets

LIFTING SLING WITH EXCESSIVE ELONGATION WARNING INDICATOR

BACKGROUND OF THE INVENTION

This invention relates generally to the field of lifting slings, and more particularly to the field of such slings having means to sense, measure, indicate or warn of excessive elongation, strain, tension or impending failure.

Lifting slings are devices similar to ropes, cables or chains that are used to lift large, heavy objects, typically with a crane or similar piece of equipment, with the sling being connected to or encircling the object and connected to a hook or similar attachment means on the crane. The lifting slings typically comprise one or more elongated bundles of fiber, thread or yarn forming a load-bearing core that is encased within a cover, jacket, sleeve, skein or the like. The fibers, yarns or threads are usually composed of a synthetic material, such as for example polyester or Kevlar, formed as multi-filaments or monofilaments, and they may be twisted or braided. The slings are typically of one of three types, either round (having the ends of the sling joined to each other to form a circle), flat web (having an elongated main body, the ends of which are bent back and secured to the body to form eyelets on each end), or eye-and-eye (a round sling enclosed with an elongated sleeve such that only relatively short loops extend from each end of the cover). Lifting slings are well known in the art, and examples are shown in U.S. Pat. No. 4,210,089 to Lindahl, U.S. Pat. No. 4,850,629 to St. Germain, and U.S. Pat. No. 5,727,833 to Coe.

Lifting slings are load rated so that the operator does not attempt to lift too great a weight for a given sling. It is typical, for example, for a sling to be load rated at one fifth of its failure strength, such that a sling that would fail under a load of 30,000 pounds would be load rated for safe operation for loads up to 6,000 pounds. It is quite common under real working conditions that the actual weight of objects being lifted is not known, and thus there may be many occasions where loads are lifted by a sling where unbeknownst to the operator the load exceeds the load rating of the sling. In addition, the tenacity or resistance-to-elongation of a sling is likely to increase over time, such that load weights significantly below the load rating may be unsafe and result in failure for slings that have been weakened by excessive use, undetected damage or environmental degradation.

All lifting slings elongate under heavy load to some degree, with slings made of polyester having greater elongation under load than a similarly rated sling composed of Kevlar or Aramid fibers. For example, a fourteen foot polyester sling load rated at 6,000 pounds may elongate up to five inches for a load approaching 6,000 pounds. Because elongation occurs under load, certain means for measuring or sensing the amount of elongation or any defects in continuity of the fiber core of a sling have been developed. Examples of such are shown in U.S. Pat. No. 4,757,719 to Franke and U.S. Pat. No. 5,651,572 to St. Germain, which disclose means comprising electrical circuits or optical fibers. Such systems add significant costs to the slings and are subject to environmental degradation or operational damage.

It is an object of this invention to provide an elongation measuring or sensing means that provides an indication or warning to an operator that a load is approaching or exceeding the maximum safe load weight for a given sling. It is a further object to provide such a sling wherein the excessive elongation warning means is an integral component of the sling. It is a further object to provide such a sling wherein the excessive elongation warning means is relatively low cost, easily read and not readily susceptible to damage or degradation from environment or use. It is a further object to provide such a sling wherein the excessive elongation warning means is compatible with round, flat web or eye-and-eye slings.

SUMMARY OF THE INVENTION

The invention is a lifting sling of the type comprising one or more elongated bundles of synthetic fiber, threads, yarn or the like, provided in multi-filament or monofilament form, preferably twisted or braided, and encased within an elongated cover or jacket, the fiber bundles comprising the load bearing core of the sling. The lifting sling may be of any configuration, such as for example round, flat web or eye-on-eye.

Excessive elongation warning indicator means are provided, the dynamic indicator means comprising warning markings, indicia or other visible members that are disposed on, incorporated in, imprinted on or attached to the cover of the sling, and a static or stationary non-elongating body, housing or member that comprises demarcation means, such that the demarcation means references the markings in a visible manner, such that an observer may readily determine the extent of elongation of the sling and whether the sling is approaching or exceeding the maximum safe load. Preferably, the dynamic warning markings are non-uniform, having variations in color, size or content, such that certain markings indicate a safe load, other markings indicate a load approaching the maximum safe load, and still other markings indicate that the safe load has been exceeded. The static non-elongating body is affixed to the sling at a single location using suitable fastener means, such that relative motion between the load-bearing components of the sling and the non-elongating body occurs when the sling elongates under load. The demarcation means may include, for example, the non-affixed end of the non-elongating body, a slot, a window, a pointer, or similar structures.

DETAILED DESCRIPTION OF THE INVENTION

With reference to the drawings, the invention will now be described in detail with regard for the best mode and the preferred embodiment. In general, the invention is a lifting sling that comprises indicator means to provide a visible warning to the operator when the elongation of the sling due to heavy load weight approaches or exceeds the maximum safe load rate for the sling.

Figure 1:
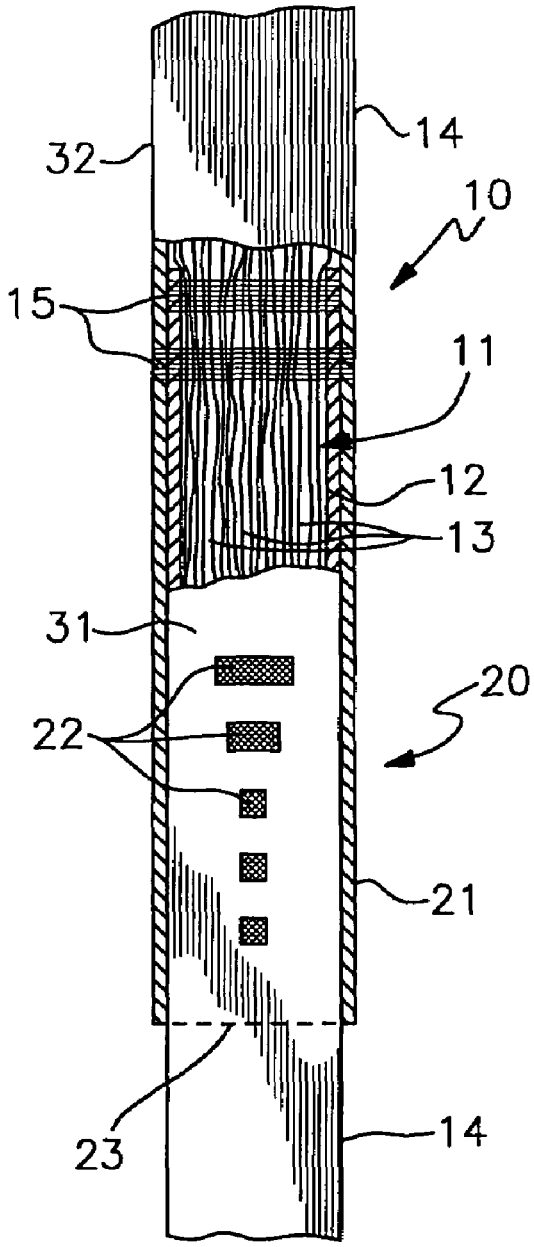
FIG. 1 is an exposed partial view of a round lifting sling in a non-load condition, such that the dynamic warning markings are concealed by the static non-elongating body of the excessive elongation warning indicator means, the non-elongating body comprising an extended portion of the sling cover.

As shown in FIG. 1, a representative lifting sling 10 comprises a load bearing core 11 formed of one or more extended fiber bundles 12 that are enclosed within an extended cover, jacket, skein, sleeve or the like 14. The fiber bundles 12 comprise fibers, threads, yarn or the like 13 most preferably composed of synthetic material such as polyester, Kevlar, Aramid or the like. The fibers 13 may be multi-filament or monofilament, and may be twisted, braided, interwoven or the like. While a sling 10 having a single core 11 is depicted in the drawings, it is to be understood that the sling of the invention may also comprise multiple cores 11. The round sling 10 depicted in FIG. 1 has a first end 31 disposed within a second end 32 in known manner and the cover 12 of the second end 32 is extended to receive the first end 31. The fiber bundle 12 is secured to the cover 14 both the first end 31 and the second end 32 by suitable bundle joining means 15, such as stitching, mechanical fasteners or the like. The load bearing core 11 and cover 14 are dynamic components of the sling 10, in that they will elongate to some degree when under heavy load.

Figure 2:
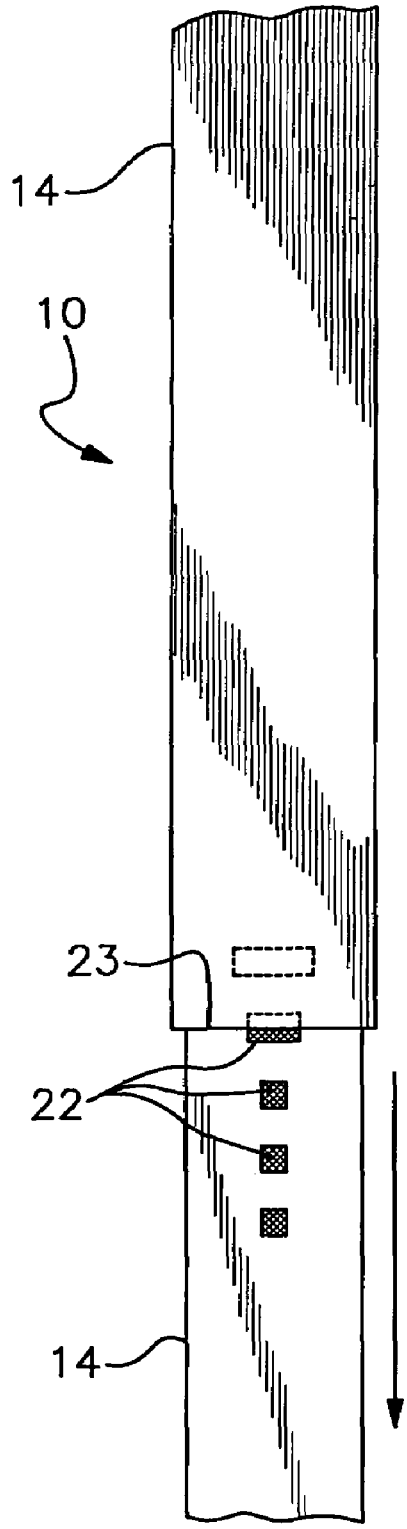
FIG. 2 is an external partial view of the lifting sling of FIG. 1 under a load condition that does not exceed the maximum safe load weight for the sling, showing exposure of the dynamic warning markings as the load-bearing components of the sling elongate under load.

In this embodiment as depicted in FIGS. 1 and 2, the excessive elongation warning indicator means 20 comprises a static non-elongating body 21 that is composed of the extended sleeve portion of cover 14 on the second end 32, and one or more dynamic warning markings, indicia or similar visible members 22 disposed on, imprinted upon, attached to or joined in suitable manner to the cover 14 adjacent the first end 31. The dynamic warning markings 22 may be of any shape or configuration, preferably being non-uniform for easier visual recognition, and may for example comprise similar shapes of changing dimensions, shapes of differing configurations, changes in color, wording such as "safe", "caution" and "overload", weight percents such as "20%", "40%", "60%", "80%" and "100%", etc., as long as the markings 22 provide suitable visible indication as to the extent of elongation of the sling 10 relative to its maximum safe load weight. The indicator means 20 further comprises static demarcation means 23 to reference a particular warning marking 22, with the demarcation means 23 comprising an edge, end, line, pointer or similar means to designate the marking 22 corresponding to the extent of elongation of the sling 10. In FIGS. 1 and 2, the demarcation means 23 is simply the end of the static non-elongating body 21. The warning markings 22 are dynamic in the sense that they move relative to the static demarcation means 23. The separation distance between the individual warning markings 22 may remain the same, such as when a non-elongating material is affixed to the cover 14, or may increase due to elongation under load, such as when the warning markings 22 are imprinted directly on the cover 14. Some, all or none of the warning markings 22 may be covered by the non-elongating body 21 and/or exposed by the demarcation means 23. Preferably, the warning marking 22 indicating that the load rating has been exceeded remains covered by the non-elongating body 21 until that condition is reached.

As shown in FIG. 2, which depicts a typical load condition wherein the sling 10 is elongated under the weight of the object being lifted, the static non-elongating body 21 remains of unchanged dimension even with the sling loaded, since the indicator means body 21 and the demarcation means 23, here the free end of the non-elongating body 21, are only fixed to the sling 10 by fastener means 24 at one location and are not load bearing components. In other words, relative motion occurs between the dynamic components, cover 14 containing the markings 22, and the static components, non-elongating body 21 and demarcation means 23. As the sling 10 elongates under load, the cover 14 elongates such that some or all of the warning markings 22 are moved into an exposed position beyond the demarcation means 23. As depicted in FIG. 2, the sling 10 has elongated under load such that the maximum safe load weight is being approached but not exceeded, since the maximum load warning marking 22, shown as the longest of the bars, is not exposed.

Figure 3:
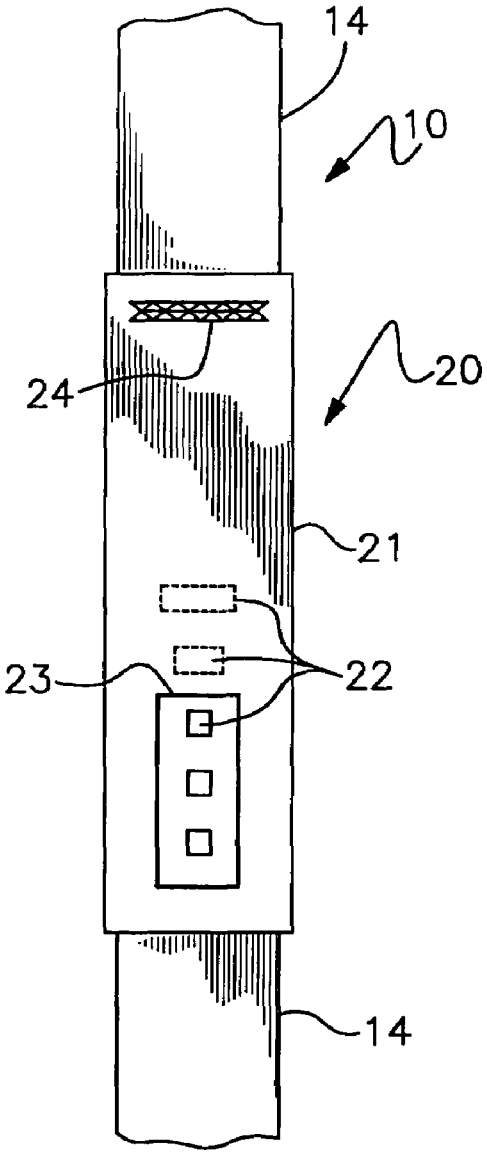
FIG. 3 is a partial view of a lifting sling of any type in a non-load condition showing the static non-elongating body as being an added member affixed to the sling cover, the demarcation means of the excessive elongation warning indictor means comprising a window or slot disposed in the body.
Figure 4:
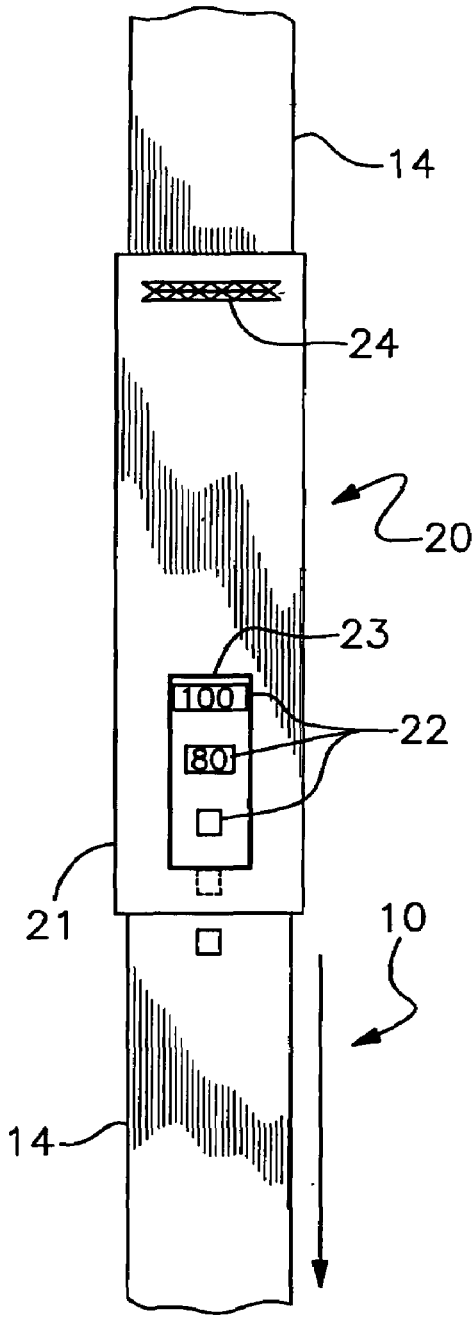
FIG. 4 is a partial view of the lifting sling of FIG. 3 under a load condition that exceeds the maximum load weight for the sling.

An alternative embodiment for the invention is shown in FIGS. 3 and 4, which may comprise a round, flat web or eye-on-eye sling 10. In this embodiment, the excessive elongation warning indicator means 20 comprises a static non-elongating body 21, such as a tubular member, that is affixed by fastener means 24 to the dynamic cover 14 of the sling 10. Such excessive elongation warning indicator means 20 could also be a post-manufacture addition to slings already in use. In this embodiment, the demarcation means 23 comprises a slot or window, such that the warning markings 22 are visible therethrough. When the sling 10 is under load, as shown in FIG. 4, the cover 14 elongates and the position of the warning markings 22 relative to the demarcation means 23 changes. In this depiction, 100% of the maximum safe load weight has been reached and is indicated by visible exposure of the "100" warning marking 22, and the operator should either lighten the load or switch to a higher rated sling.

The separation distances of the warning markings 22 on the dynamic load bearing components of the lifting sling 10 will vary depending on the material components of the sling 10 primarily that of the load bearing core 11, since different materials will have different elongation amounts under the same load. More than one excessive elongation warning indicator means 20 may be provided on a single sling 10.

It is understood that equivalents and substitutions to certain elements set forth above may be obvious to those skilled in the art, and therefore the true scope and definition of the invention is to be as set forth in the following claims.

I claim:

1. A lifting sling comprising a load bearing core, a cover and excessive elongation warning indicator means, wherein said load bearing core and said cover elongate under load;

said excessive elongation warning indicator means comprising a non-elongating body attached to said cover, wherein said non-elongating body is non-load bearing and comprises an extended portion of said cover, and warning markings disposed on said cover, said non-elongating body further comprising demarcation means to indicate in combination with said warning markings the extent of elongation of said sling.

2. The sling of claim 1, wherein said demarcation means comprises the end of said extended portion of said cover.

3. The sling of claim 1, wherein said demarcation means comprises a window disposed in said extended portion of said cover.

4. The sling of claim 1, wherein said warning markings are chosen from the group of warning markings consisting of differing shapes, differing colors, words and numbers.

5. The sling of claim 1, wherein said non-elongating body is tubular.

6. The sling of claim 1, wherein said demarcation means comprises a window disposed in said non-elongating body.

7. A lifting sling comprising a dynamic load bearing core, a dynamic cover and excessive elongation warning indicator means;

said excessive elongation warning indicator means comprising a static non-elongating body attached to said cover, wherein said non-elongating body is non-load bearing and comprises an extended portion of said dynamic cover, and warning markings disposed on said cover, said static non-elongating body further comprising demarcation means to indicate in combination with said warning markings the extent of elongation of said sling.

8. The sling of claim 7, wherein said demarcation means comprises the end of said extended portion.

9. The sling of claim 7, wherein said demarcation means comprises a window disposed in said extended portion.

10. The sling of claim 7, wherein said warning markings are chosen from the group of warning markings consisting of differing shapes, differing colors, words and numbers.

11. The sling of claim 7, wherein said static non-elongating body is tubular.

12. The sling of claim 7, wherein said demarcation means comprises a window disposed in said static non-elongating body.

13. A lifting sling comprising a dynamic load bearing core, a dynamic cover and excessive elongation warning indicator means, wherein said dynamic load bearing core and said dynamic cover elongate under load, said sling having a load rating for the maximum load to be lifted by said sling;

said excessive elongation warning indicator means comprising a static non-elongating body attached to said dynamic cover, wherein said static non-elongating body is non-load bearing, and warning markings disposed on said cover, said static non-elongating body further comprising demarcation means to indicate in combination with said warning markings the extent of elongation of said sling, wherein at least some of said warning markings are covered by said static non-elongating body when the load being lifted by said sling does not exceed said load rating.

14. The sling of claim 13, wherein at least some of said warning markings are exposed by said demarcation means at all times.

15. The sling of claim 13, wherein said demarcation means comprises the end of said static non-elongating body.

16. The sling of claim 13, wherein said demarcation means comprises a window disposed in said static non-elongating body.

17. The sling of claim 13, wherein said warning markings are chosen from the group of warning markings consisting of differing shapes, differing colors, words and numbers.

18. The sling of claim 13, wherein said static non-elongating body is tubular.

* * * * *